US006281850B1

(12) United States Patent
Klostermann

(10) Patent No.: US 6,281,850 B1
(45) **Date of Patent: *Aug. 28, 2001**

(54) BROADBAND MULTIPLE ELEMENT ANTENNA SYSTEM

(75) Inventor: Daniel J. Klostermann, Cedar Rapids, IA (US)

(73) Assignee: Intermec IP Corp., Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/888,660

(22) Filed: Jul. 7, 1997

Related U.S. Application Data

(63) Continuation-in-part of application No. 08/800,399, filed on Feb. 14, 1997, now abandoned

(60) Provisional application No. 60/011,844, filed on Feb. 16, 1996.

(51) Int. Cl.[7] ..... H01Q 21/26; H01Q 3/20

(52) U.S. Cl. ..... 343/702; 343/700 MS

(58) Field of Search ..... 343/872, 824, 343/826, 878, 898, 702, 700 MS, 770, 711, 895

(56) References Cited

U.S. PATENT DOCUMENTS 4,356,492 * 10/1982 Kaloi ..... 343/700 MS
5,440,318 * 8/1995 Butland et al. ..... 343/814

* cited by examiner

*Primary Examiner*—Don Wong
*Assistant Examiner*—James Clinger
(74) *Attorney, Agent, or Firm*—Akin, Gump, Strauss, Hauer & Feld, L.L.P.

(57) ABSTRACT

A broadband antenna system includes a plurality of antenna elements, a plurality of phase shifting elements, and a circuitry connection. Each of the antenna elements has a respective antenna element operating bandwidth dependent upon the construction of the element. Each phase shifting element connects a respective one of the plurality of antenna elements to a common antenna connection with a respective bandwidth shift. The circuitry connector couples the common antenna connection to radio circuitry. With the plurality of antenna elements bandwidth shifted by the plurality of phase shifting elements, the antenna elements operate in combination with an operating bandwidth a multiple of the element operating bandwidths. The circuitry connector transforms a frequency design range harmonic impedance at the common antenna connection to a minimum impedance at a second end of the circuitry connector that connects to radio circuitry. The antenna system may be part of a radio module that includes a radio module shell containing radio circuitry, with the plurality of antenna elements substantially conforming to the radio module shell. The plurality of antennas may reside upon a dielectric layer disposed upon an external portion of the radio module shell. The circuitry connector extends through the radio module shell and dielectric layer to connect the radio circuitry to the plurality of antenna elements. Insulative spacers may connect the plurality of antenna elements to the dielectric layer such that the antenna elements reside adjacent to, and at least partially away from, the dielectric layer to enhance performance.

16 Claims, 13 Drawing Sheets

BROADBAND MULTIPLE ELEMENT ANTENNA SYSTEM

CROSS-REFERENCE TO RELATED APPLICATIONS

The present application is a continuation in part of U.S. patent application Ser. No. 08/800,399, filed Feb. 14, 1997, now abandoned, which in turn claimed priority under 35 U.S.C. Sec. 119(e) to U.S. Provisional Application Serial No. 60/011,844 filed Feb. 16, 1996. Such applications are hereby incorporated herein by reference in their entirety.

BACKGROUND

1. Technical Field

The present invention relates generally to wireless communications, and, specifically, to an antenna system that includes a plurality of antenna elements, each of which is phase shifted so that the antenna system provides a relatively wide bandwidth of operation. The present invention further relates to an antenna system having phase shifting circuitry that produces an apparent short circuit to connected radio circuitry at harmonic frequencies of a frequency design range.

2. Related Art

It is well known to couple an antenna to radio circuitry contained within a host unit to enable wireless communication between the host unit and remotely located units. Typical implementations of such technology include cellular systems wherein portable terminals wirelessly communicate voice and data information to and from central locations via a wireless link.

A particular problem in the design of portable terminals operating in such systems relates to the antennas employed. Such antennas must perform adequately within a frequency design range while not interfering with space considerations and other physical aspects of the portable terminal. Antennas that protrude from the portable terminal perform well, but cause problems where the terminal must be able to dock into another device, and tend to be susceptible to breakage in rugged environments. Antennas that conform to the outer perimeter of the portable terminal do not interfere with physical aspects of the portable terminal, but their characteristics at harmonic frequencies do not always conform to FCC power level requirements, such requirements limiting permissible emissions at harmonic frequencies of the frequency design range.

In many applications, such as with spread-spectrum radio technology that has become popular in portable radio terminal communications, antennas must be designed to operate over a relatively large bandwidth. As the physical size of antennas decreases, however, so does respective bandwidth and gain. Prior, non-protruding antennas provided insufficient bandwidth and gain in spread-spectrum applications. Thus, heretofore, protruding antennas have proven the solution of choice in spread-spectrum applications even though they are often damaged during use.

Thus, there lies a need for an improved internal antenna design that provides adequate performance, operates adequately over a large bandwidth, conforms to FCC harmonic power level requirements, and yet is reasonably inexpensive to implement in portable terminals.

SUMMARY OF THE INVENTION

In one embodiment of the present invention a broadband antenna system includes a plurality of antenna elements, a plurality of phase shifting elements, and a circuitry connection. Each of the antenna elements has a respective antenna element operating bandwidth dependent upon the construction of the element. Each phase shifting element connects a respective one of the plurality of antenna elements to a common antenna connection with a respective bandwidth shift. The circuitry connector couples the common antenna connection to radio circuitry. With the plurality of antenna elements bandwidth shifted by the plurality of phase shifting elements, the antenna elements provide an antenna system with an operating bandwidth a multiple of the element operating bandwidths.

The circuitry connector transforms a frequency design range harmonic impedance at the common antenna connection to a minimum impedance at connected radio circuitry. Thus, with the frequency design range extending from approximately 902 Megahertz to approximately 928 Megahertz, the designated spread-spectrum bandwidth, transmitted harmonics are diminished to comply with FCC rules.

In one embodiment, the antenna system is part of a radio module that inserts into a portable terminal for operation. The radio module includes a radio module shell that contains the radio circuitry, with the plurality of antenna elements substantially conforming to the radio module shell. In the embodiment, a dielectric layer is disposed upon an external portion of the radio module shell and the plurality of antenna elements are disposed upon the dielectric layer. In the embodiment, the circuitry connector extends through the radio module shell and dielectric layer to connect the radio circuitry to the plurality of antenna elements.

In another embodiment, a plurality of insulative spacers connect the plurality of antenna elements to the dielectric layer such that the antenna elements reside adjacent to, and at least partially away from, the dielectric layer. In this fashion, the insulative spacers may be constructed to position the plurality of antenna elements with respect to the radio module shell to enhance performance.

In still other embodiments, a portion of the plurality of antenna elements substantially conforming to the radio module shell while a portion of the plurality of antenna elements substantially conform to the radio circuitry contained within the shell. In still further embodiments, a portion of the plurality of antenna elements reside within the radio module shell while a portion of the plurality of antenna elements reside external to the radio module shell.

Moreover, other aspects of the present invention will become apparent with further reference to the drawings and description which follow.

DETAILED DESCRIPTION

Figure 1:
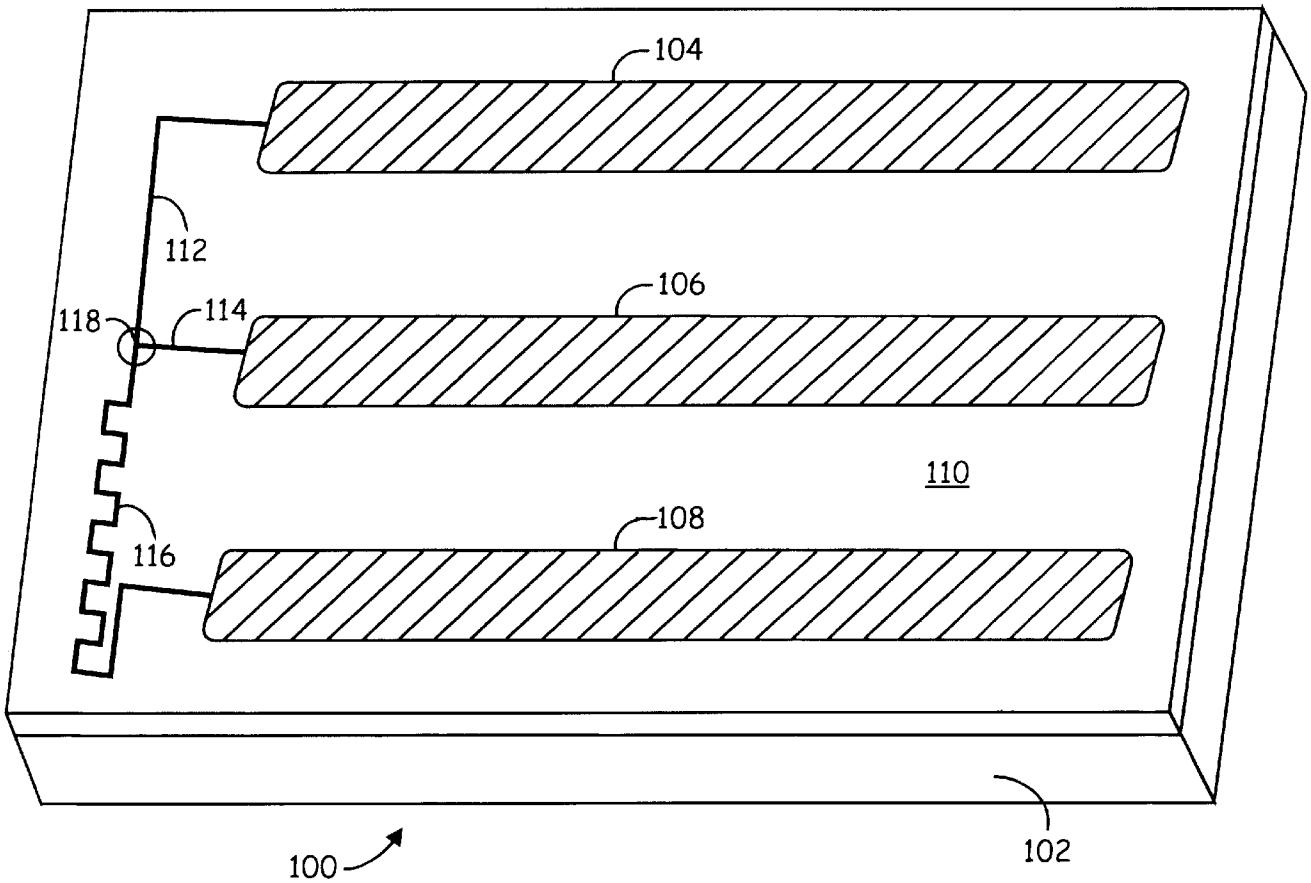
FIG. 1 is a mostly diagrammatic perspective view illustrating an antenna system disposed upon a radio module according to the present invention.

FIG. 1 illustrates an antenna system 100 constructed according to the present invention. The antenna system 100 includes a first antenna element 104, a second antenna element 106 and a third antenna element 108 disposed upon a dielectric layer 110 that resides upon a radio module shell 102. A first phase shifting element 112 connects the first antenna element 104 to a common antenna connection 118 while second 114 and third 116 phase shifting elements connect the second 106 and third 108 antenna elements to the common antenna connection 118, respectively.

As is known, operating characteristics of antenna elements vary with the size, shape, resitivity, proximity to dielectric and conductive structures as well as with various other physical properties of the antenna elements. Each of the antenna elements in the embodiment illustrated in FIG. 1 has similar operating characteristics due to their similar construction. However, in other embodiments, to be described later herein, operating characteristics of the antenna elements vary.

The particular antenna system 100 system illustrated in FIG. 1 is designed to operate over a frequency range reserved for spread-spectrum communications, the range generally extending from 902 to 928 Megahertz (MHz). Thus, the design of the antenna elements individually, and the antenna system 100 as a whole, is optimized for operation over this frequency range. Nonetheless, the teachings of the present invention apply to other frequency ranges as well.

As previously described, an operating difficulty associated with many wireless devices relates to the protruding nature of conventional antennas. While protruding antennas may present few problems when used with stationary wireless devices not limited to a physical space, protruding antennas often interfere with the operation of portable units, such as hand-held terminals, the antennas often being damaged during use. Therefore, as illustrated in FIG. 1, the antenna system 100 according to the present invention does not protrude from the radio module shell 102 upon which it is mounted so that it may not be damaged during normal use. Further, when attached to a host unit, such as a portable terminal, the antenna system 100 does not protrude from the portable terminal in a fashion which interferes with the operation of the portable terminal.

In the design of the antenna system 100 of FIG. 1, performance across a frequency design range, e.g. 902 MHz to 928 MHz, is required. The use of relatively small antenna elements 104, 106 and 108 such as those illustrated in FIG. 1 typically produces a narrow bandwidth due to the small dimensions of the antenna elements relative to wavelengths in the frequency design range. However, as will be further described herein, each of the antenna elements 104, 106 and 108 exhibits adequate performance across a relatively narrow bandwidth. To compensate for such narrow bandwidths, the antenna system 100 according to the present invention employs the phase shifting elements 112, 114 and 116 to frequency shift the bandwidths of each of the antenna elements 104, 106 and 108. Once frequency shifted, the bandwidths are presented at the common antenna connection 118. By selectively frequency shifting the bandwidths of the antenna elements 104, 106 and 108, the antenna system 100 exhibits a wider bandwidth than does any of the antenna elements 104, 106 and 108 individually. Phase shifting elements 112, 114 and 116 provide transmission paths of varying lengths between their respective antenna elements and the common antenna connection 118, the respective phase shifts also providing the desired bandwidth shifts.

Figure 2A:
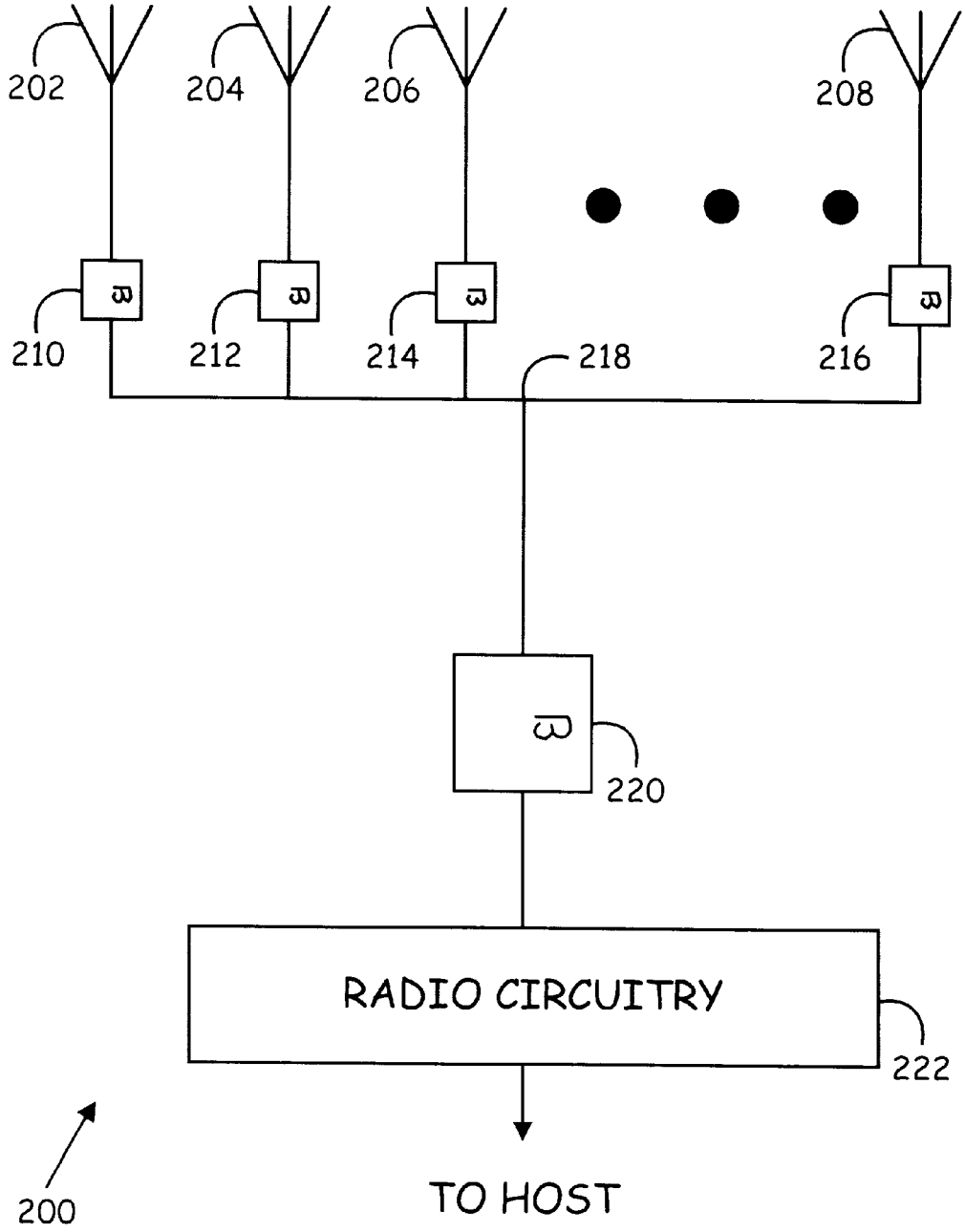
FIG. 2A is an schematic diagram illustrating an equivalent circuit of the antenna system of FIG. 1 according to the present invention.

FIG. 2A is an schematic diagram illustrating generally an equivalent circuit of an antenna system 200 similar to the antenna system 100 of FIG. 1. For illustrative purposes, FIG. 2A shows four antenna elements 202, 204, 206 and 208. However, in other embodiments as few as two antenna elements or in excess of four antenna elements could be employed in constructing the antenna system 200. The antenna elements 202, 204, 206 and 208 connect to a common antenna connection 218 via phase shifting elements 210, 212, 214 and 216, respectively.

The circuitry connection 220 phase shifts the impedance of the antenna system at the common antenna connection 218 prior to its connection to radio circuitry 222. However, the circuitry connection 220 is designed so that the impedance presented to the radio circuitry is minimized at harmonics of the frequency design range while providing satisfactory performance over the frequency design range. In the embodiment illustrated, the circuitry connection 220 transforms the impedance of the antenna system at the common antenna connection 218 so that it presents a short to the radio circuitry 222. Impedance transformations, as well as bandwidth shifting, using same or similar techniques, is known in the art and will not be further described herein except to expand upon the teachings of the present invention.

Figure 2B:
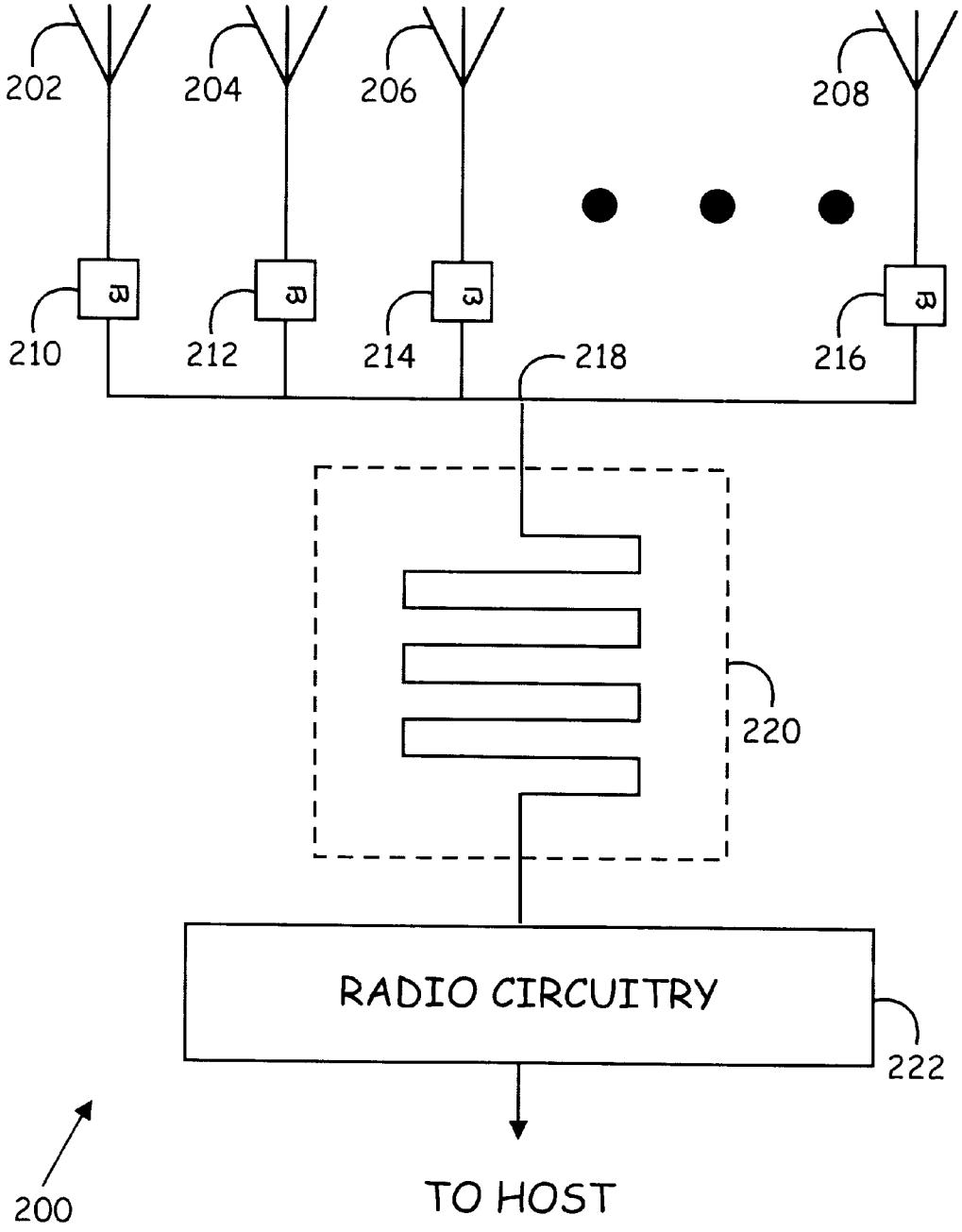
FIG. 2B is a schematic diagram similar to FIG. 2A but showing an exemplary embodiment of a circuitry connector according to the present invention.

FIG. 2B is a schematic diagram similar to FIG. 2A but in addition showing an exemplary embodiment of a circuitry connector 220 according to the present invention. Numbering conventions remain consistent with FIG. 2A for common elements. As shown, the impedance at the common antenna connection 218 may be transformed using a section of transmission line, the length of which in wavelengths at a harmonic of the frequency design range, transforms the impedance so as to present a short circuit (or minimum impedance) to the radio circuitry 222 at the harmonic of the frequency design range. By presenting a short circuit to the radio circuitry 222, the radio circuitry 222 can deliver no power for transmission to the antenna elements 202, 204, 206 and 208, thus complying with FCC requirements. In other embodiments of the antenna system 200, the circuitry connector 220 may include tuning stubs, shorts or lumped elements to assist in presenting a short circuit (or minimum impedance) to the radio circuitry 222 at the harmonic frequencies of the frequency design range.

Figure 3:
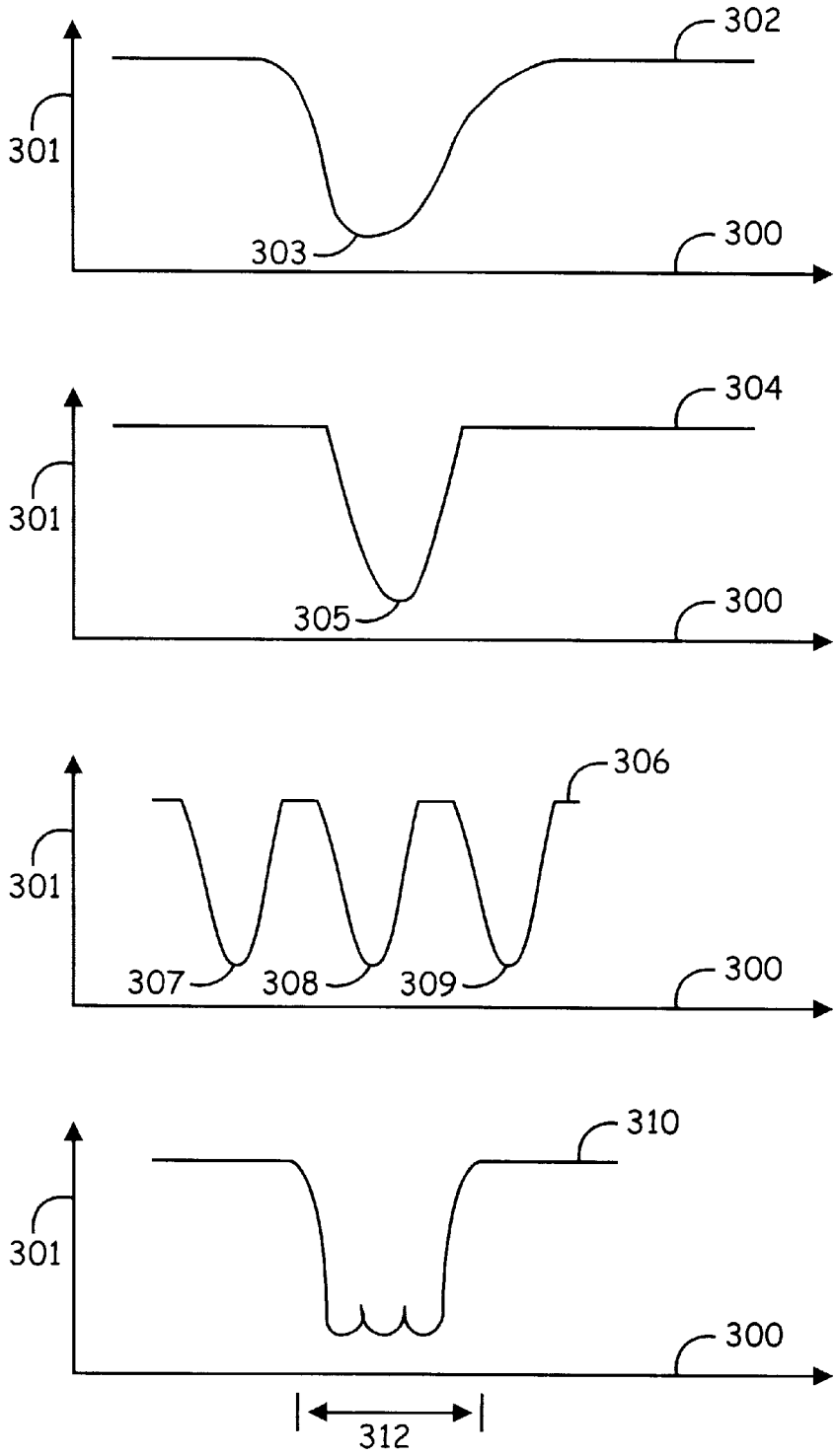
FIG. 3 is a collection of graphs illustrating return loss characteristics of an antenna system according to the present invention as compared to return loss characteristics of other antennas.

FIG. 3 is a collection of graphs illustrating operating characteristics of an antenna system according to the present invention as compared to individual antenna characteristics. In particular, the collection of graphs compares characteristics of a three antenna element antenna system, same or similar to the antenna system 100 of FIG. 1, to characteristics of individual antennas. Each of the graphs plots return loss in decibels (dB) on the vertical axis versus frequency on the horizontal axis. Return loss is a measure of energy not radiated by an antenna which "returns" to the radio circuitry.

UHF antenna return loss characteristics 302 shows that a respective UHF antenna has a minimum return loss at a center design frequency 303 at which point the antenna provides maximum transmission of energy delivered to it by the radio circuitry. While the UHF antenna exhibits a relatively wide bandwidth, its relatively large construction is unsuitable for those uses contemplated by the antenna system according to the present invention.

One-element antenna return loss characteristics 304 provide a minimum return loss at a center design frequency 305 but has a relatively narrow bandwidth. Such return loss characteristics may be produced by one of the antenna elements 104, 106 or 108 of the antenna system 100 illustrated in FIG. 1. The return loss characteristics 306 of a three-element antenna system wherein the bandwidths of the antenna elements are frequency shifted with respect to one another produces minimum return loss at three separate frequencies 307, 308 and 309. With the frequency shifting of these three elements correctly executed, bandwidths of the antenna elements overlap to produce the three-element antenna system return loss characteristics 310 illustrated, such return loss characteristics corresponding to the antenna system 100 illustrated with reference to FIG. 1. As is illustrated, the bandwidth 312 extends across the frequency design range, 902 to 928 MHz in the present embodiment.

The teachings of the present invention may be extended to antenna systems having two antenna elements or in excess of three antenna elements, depending upon the requirements of the particular design. As is apparent from FIG. 3, application of the teachings of present invention for a five antenna element system, for example, would produce return loss characteristics across a design range with five sub-minimas of return loss, each of the sub-minimas corresponding to one of the five antenna elements of the antenna system.

Figure 4A:
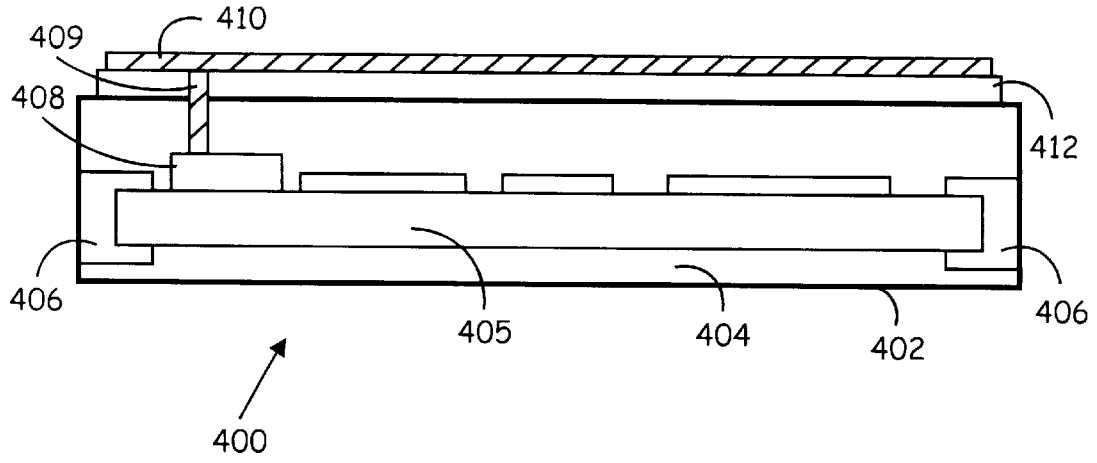
FIG. 4A is a sectional side view of a radio module including an antenna system according to the present invention.

FIG. 4A is a sectional side view of a radio module 400 including an antenna system according to the present invention. The radio module 400 includes a radio module shell 402 formed of a thin, light-weight metal and adapted to be received by a portable terminal, such as a hand-held portable data terminal. The radio module 400 interfaces with a host system via a PCMCIA, PCI, ISA or other standard or proprietary interface. The radio module 400 could also be received by other portable devices such as code readers, scanners, printers and other portable devices that employ wireless communications. Further, the radio module 400 could also be used with a stationary device as well.

The radio module includes radio circuitry 404 contained within the radio module shell 402. The radio circuitry 404 includes, for example, a radio processor, a radio transceiver, memory, host interface circuitry and various other circuitry mounted on a printed circuit board 405 held in place within the radio module shell 402 by insulating mounts 406.

The circuitry connector 408 is partially mounted upon the circuit board 405 that also contains the radio circuitry 404. However, in other embodiments, the circuitry connector 408 may be disposed on an inner surface of the radio module shell 402. When the circuitry connector 408 is disposed upon an inner surface of the radio module shell 402, the circuitry connector 408 must be electrically isolated from the conductive radio module shell 402. As an example of the construction that may be employed, the circuitry connector 408 may include an insulated cable 409 that extends through the radio module shell 402 to make connection at the common antenna connection.

An antenna element 410 (other antenna elements are not shown since the FIG. is a side view) resides upon a dielectric layer 412, both of which conform to an outer surface of the radio module shell 402. For optimum performance, the dielectric layer 412 comprises a dielectric having a relatively small dielectric constant. Teflon, for example, has a relative dielectric constant of approximately 2.2 and enhances operation of the antenna element 410 by effectively reducing the wavelength of radiated waves. Thus, shorter antenna elements 410 may employed to produce equivalent performance when using the relatively lower dielectric constant material for the dielectric layer 412.

Figure 4B:
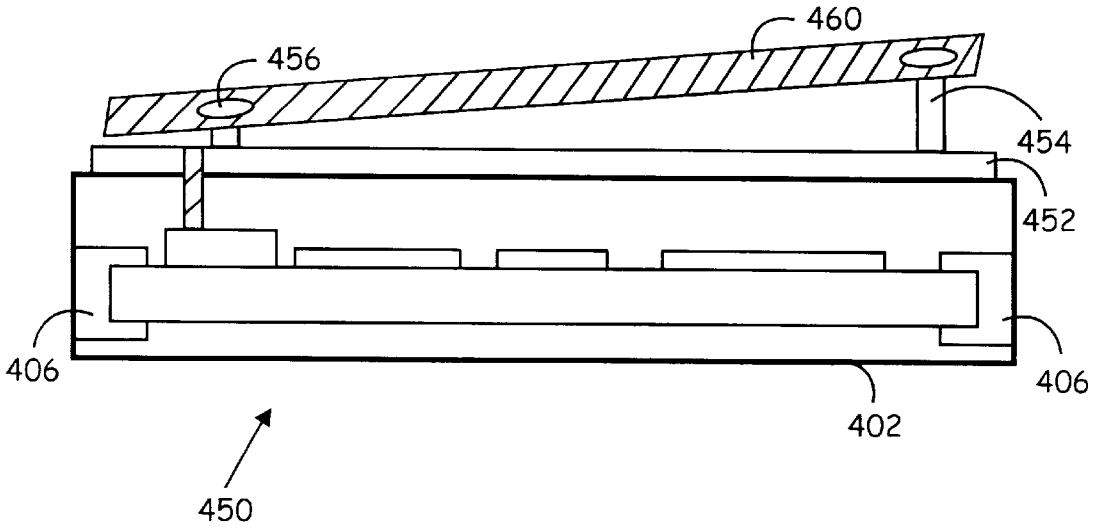
FIG. 4B is a sectional side view of an alternative radio module including an antenna system according to the present invention.

FIG. 4B is a sectional side view of an alternative radio module 450 including an antenna system according to the present invention. The radio module 450 differs from the radio module 400 of FIG. 4A in that an antenna element 460 (one of a plurality) is raised above a dielectric layer 452 that provides insulation from the conductive radio module shell 402. Insulative spacers 454, formed of nylon, for example, support the antenna element 460 above the dielectric layer 452 at an angle with respect to the dielectric layer 452. By raising the antenna element 460 above the dielectric layer 452 and by using a slightly larger antenna element 460, equivalent performance may be achieved using a less expensive, relatively lower dielectric constant material, such as FR4 which has a relative dielectric constant of approximately 4.2.

Figure 4C:
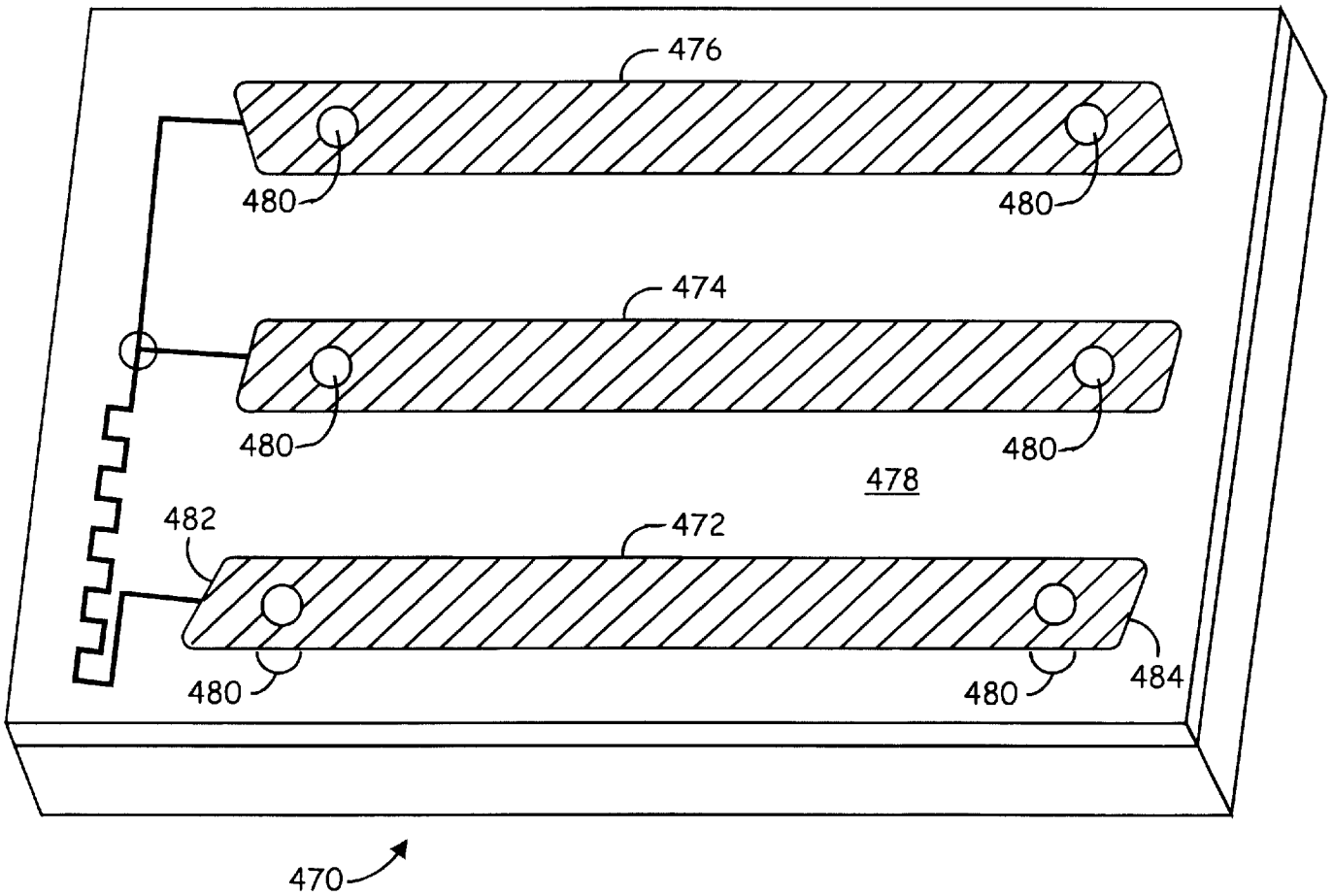
FIG. 4C is a diagrammatic perspective view of a radio module having an antenna system according to the present invention.

FIG. 4C is a diagrammatic perspective view of a radio module 470 having an antenna system constructed according to the present invention, similar to the antenna system illustrated with reference to FIG. 4B. The antenna system includes first 472, second 474 and third 476 antenna elements raised above a dielectric layer 478 residing upon the radio module shell 402. Insulating spacers 480 connect the antenna elements 472, 474 and 476 to the dielectric layer 478, positioning the elements so that an array formed by the elements has improved performance. A first end 482 of first antenna element 472 resides more closely to the dielectric layer 478 than does a second end 484 of the first antenna element 472. Thus, a longitudinal axis of the first antenna element 472 resides non-parallel to the dielectric layer 478. A horizontal axis of the first antenna element 472 also resides non-parallel to the dielectric layer. In the illustrated embodiment, the second antenna element 472 resides substantially parallel to the surface of the dielectric layer 478. Further, the third antenna element 474 orients to complement orientation of the first antenna element 470 so that, in combination, the antenna elements provide enhanced performance over a desired frequency range.

Figure 5A:
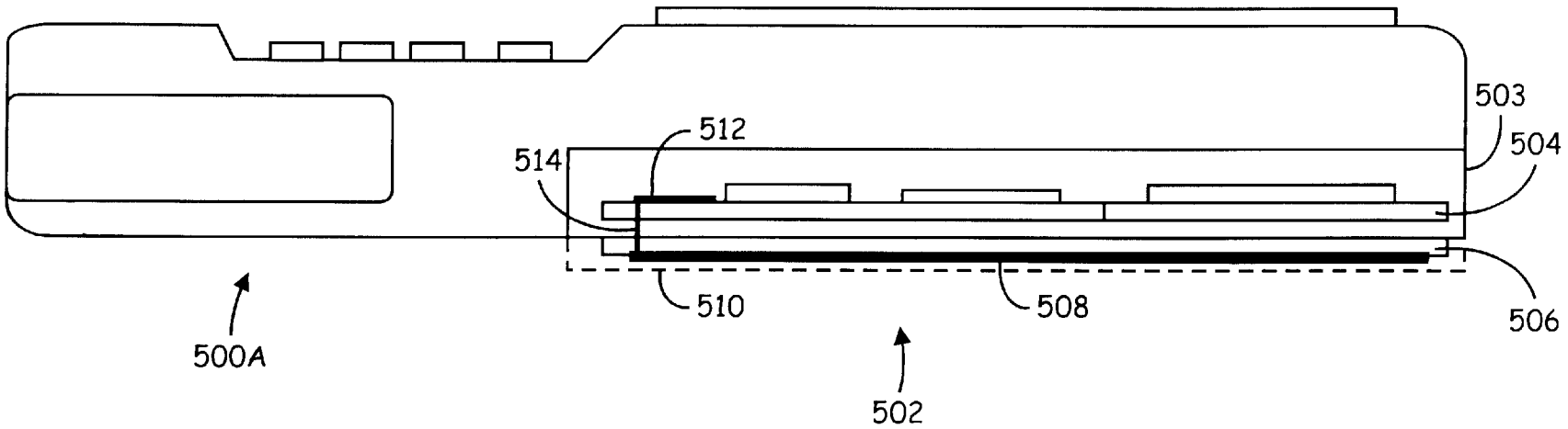
FIG. 5A is a sectional side view of a portable terminal having a radio module that includes an antenna system according to the present invention.

FIG. 5A is a sectional side view of a portable terminal 500A having a radio module 502 that includes an antenna system according to the present invention. The portable terminal 500A may include, for example, terminal processing circuitry, a display, a keypad, a battery pack and other components that may be required to perform data collection, data processing and data communication functions. While installation of the radio module 502 within the portable terminal 500A is illustrated, the radio module 502 could also be installed within scanners, code readers, digital cameras, portable printers, data pads and other units requiring a wireless communication link with a remote location.

A thin, lightweight metal radio module shell 503 houses radio circuitry 504 as well as a circuitry connector 512 that performs the previously described impedance transformations. The radio circuitry 504 includes interface circuitry that allows the radio module 502 to communicate with the portable terminal 500A.

A first antenna element 508 resides atop a dielectric layer 506 that isolates the first antenna element 508 from the radio module shell 503. Additional antenna elements are not shown in this sectional side view but reside adjacent the first antenna element 508, the construction similar to that illustrated with reference to FIG. 1. The circuitry connector 512 includes a short insulated cable section 514 that passes through a hole formed in the radio module shell 503 and that makes connection with the first antenna element 508 via a common antenna connection.

The antenna elements of the illustrated radio module 502 reside directly upon the dielectric layer 506 which resides directly upon the radio module shell 503. Thus, as previously described, the configuration requires a dielectric with a relatively low dielectric constant for maximum performance. With the illustrated compact construction, a protective covering 510 that is transmissive to generated radio waves may be constructed simply and inexpensively to protect the antenna elements and those portions of the dielectric layer exposed.

Figure 5B:
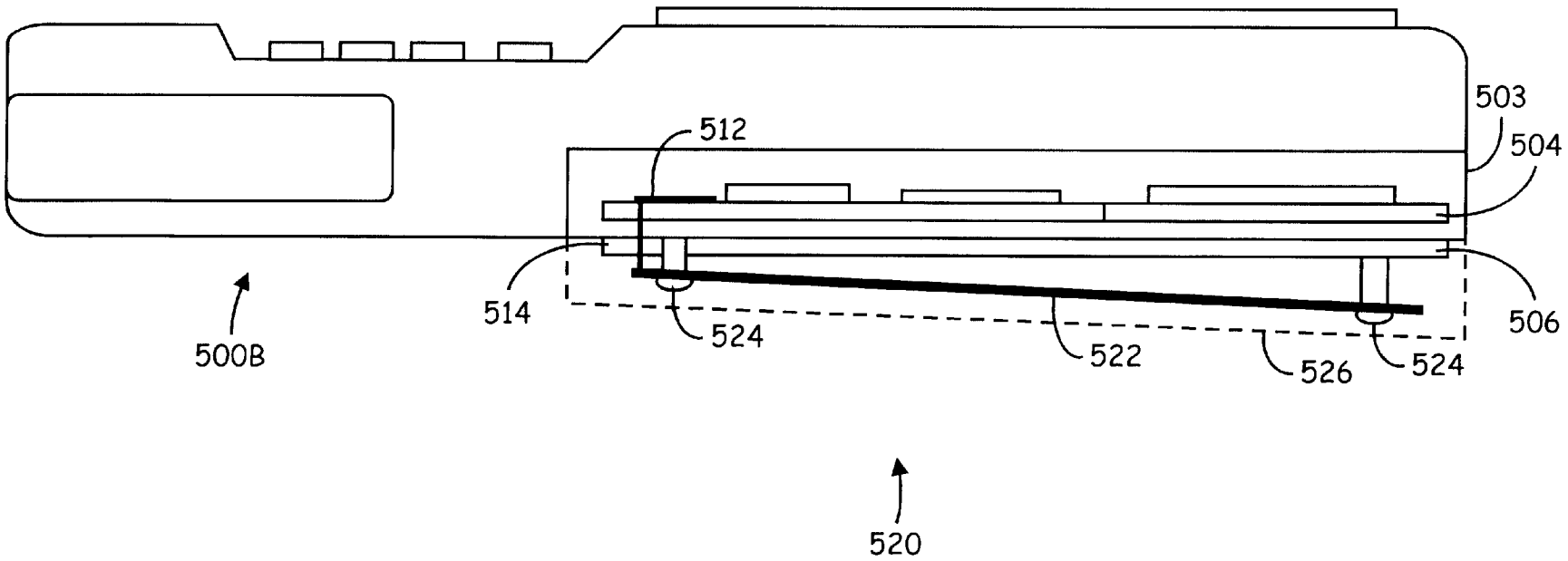
FIG. 5B is a sectional side view of a portable terminal including an alternative embodiment of an antenna system according to the present invention.

FIG. 5B is a sectional side view of a portable terminal 500B having a radio module 520 that includes an alternative embodiment of an antenna system according to the present invention. As contrasted to the construction of the radio module of FIG. 5A, the first antenna element 522 of the radio module 520 is supported adjacent the dielectric layer 506 by insulating spacers 524, such construction similar to that illustrated with respect to FIG. 4C. To protect the antenna elements, protective cover 526, constructed of a material transmissive at radio frequencies extends beyond the antenna elements and provides a barrier to contact.

Figure 5C:
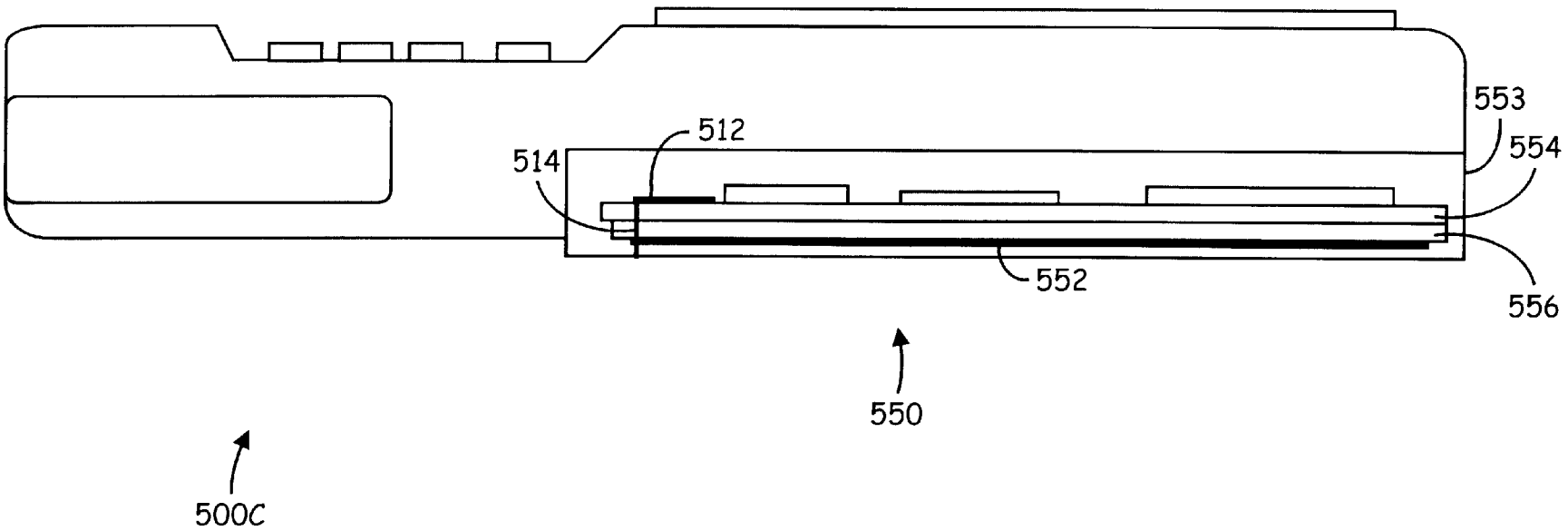
FIG. 5C is a sectional side view of a portable terminal including another alternative embodiment of an antenna system according to the present invention.

FIG. 5C is a sectional side view of a portable terminal 500C having a radio module 550 that incorporates another embodiment of an antenna system according to the present invention. The radio module 550 houses radio circuitry as well as the components of the antenna system. Thus, the radio module shell 553 is transmissive to radio waves produced by the antenna system and is constructed of plastic or another transmissive material that provides protection to the components housed within the radio module shell 553. Radio circuitry components are disposed upon a printed circuit board 554 mounted within the radio module shell 553. The printed circuit board 556 includes shielding that shields the radio circuitry components from transmissions produced by the antenna elements. A dielectric layer 556 connects directly to the shielded printed circuit board with the antenna elements residing atop the dielectric layer 556. The first antenna element 552, as well as additional antenna elements, not shown, couple to the radio circuitry via a circuitry connector 512 that includes a shielded cable 514 that that extends through the printed circuit board 556 and dielectric layer 556.

Figure 5D:
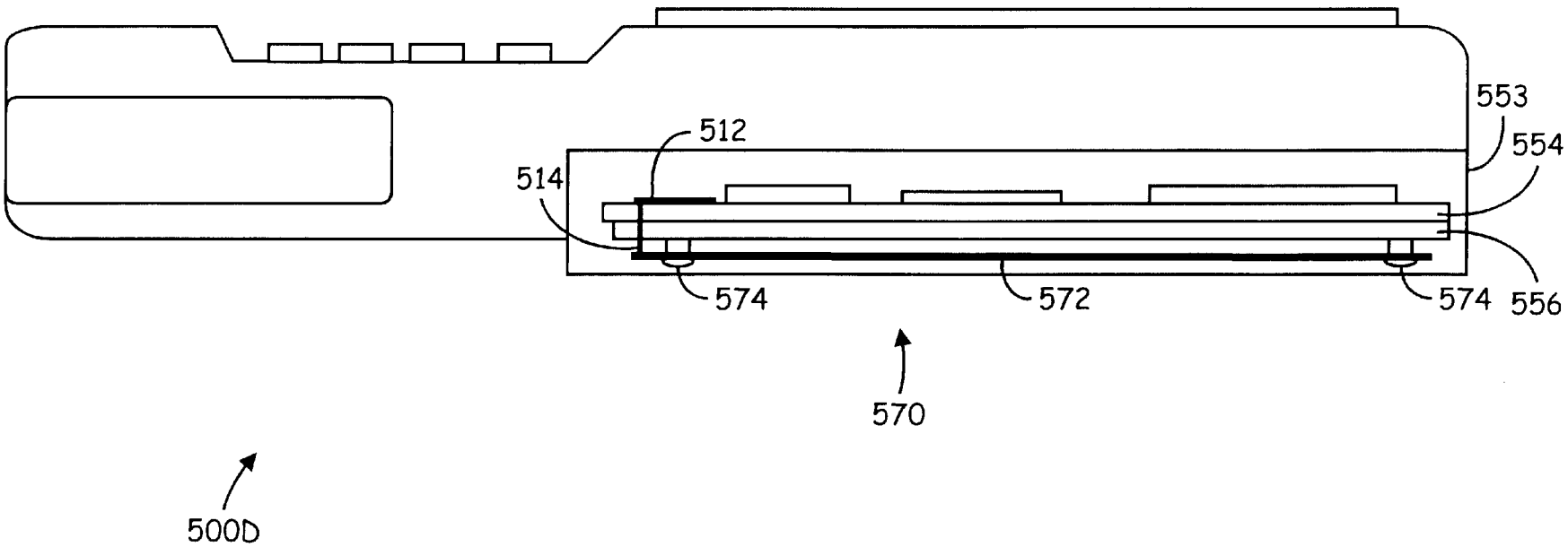
FIG. 5D is a sectional side view of a portable terminal including still another alternative embodiment of an antenna system according to the present invention.

FIG. 5D is a sectional side view of a portable terminal 500D having a radio module 570 that includes still another alternative embodiment of an antenna system according to the present invention. Construction of the radio module 570 is similar to that of the radio module 550 illustrated with respect to FIG. SC except that the first antenna element 572 (as well as other antenna elements) are located apart from the dielectric layer 556, mounted via insulative spacers 574. Thus, a dielectric having a different dielectric constant may be used with the construction of FIG. 5D to obtain performance similar to that obtained by the construction of FIG. 5C.

Figure 6A:
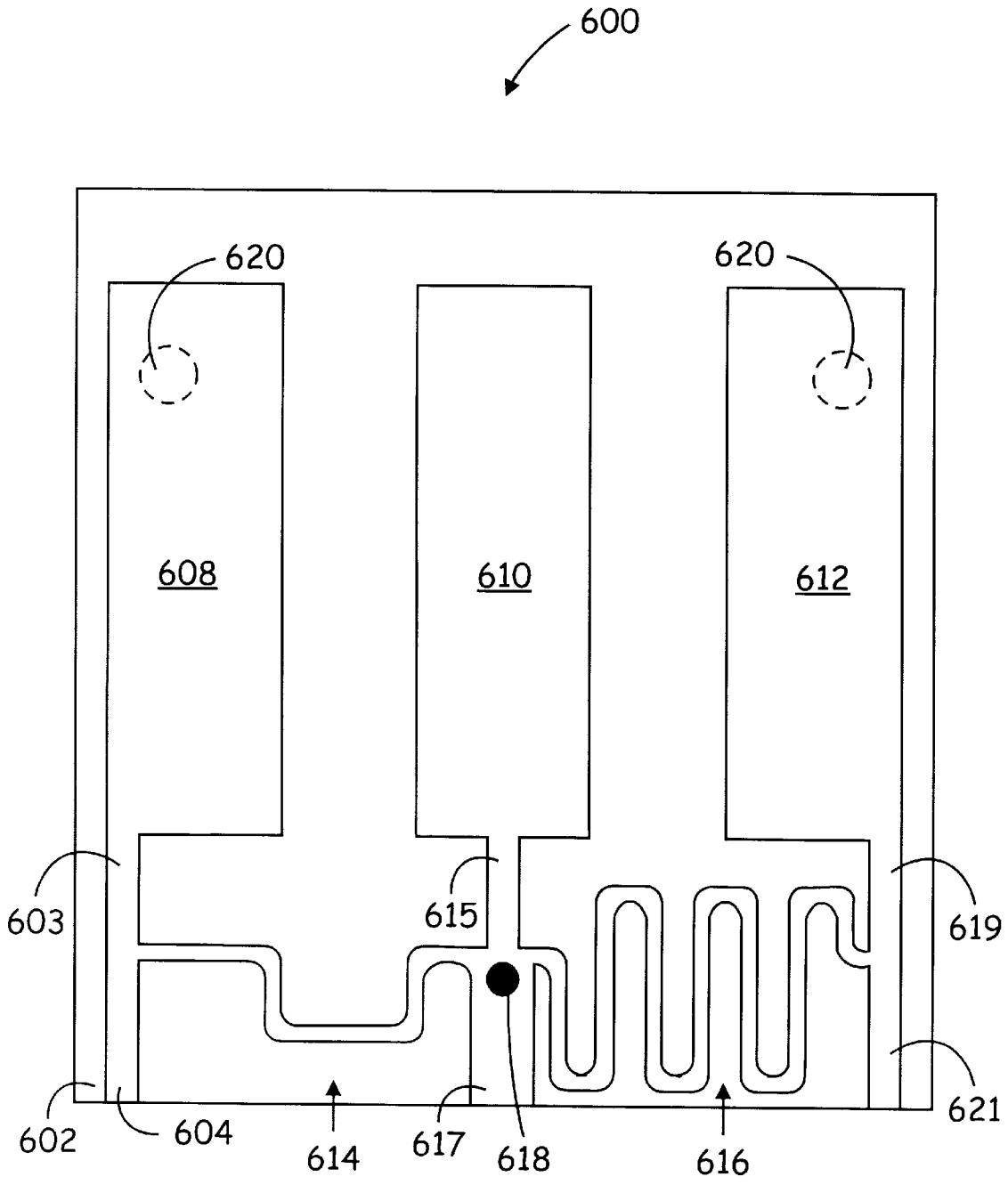
FIG. 6A is a diagrammatic top view of antenna elements of an antenna system according to the present invention.

FIG. 6A is a diagrammatic top view of a portion of an antenna system 600 according to the present invention. In the embodiment, antenna elements 600 are disposed upon a dielectric layer 602 and are formed of a conductive material such as a thin layer of copper. First 608, second 610 and third 612 antenna elements are cut separately from a sheet of copper using techniques known in the art and then be disposed upon the dielectric layer 602. The antenna elements may be either disposed directly upon the dielectric layer or be attached by insulative spacers 620 so that at least some of the antenna elements reside above the dielectric layer 602.

First 614 and second 616 phase shifting elements couple antenna elements 608, 610 and 612, respectively, to a common antenna connection 618. A circuitry connector (not shown) connects the common antenna connection 618 to radio circuitry (not shown) in a manner previously described. As illustrated the phase shifting elements 614 and 616 provide transmission paths of varying length between the common antenna connection 618 and respective antenna elements. In this fashion, the bandwidth of respective antenna elements is shifted prior to connection at the common antenna connection 618 to produce the relatively wide bandwidth of the antenna system as a whole. The phase shifting elements 614 and 616 may also have characteristic impedances that are tailored so as to perform the designed phase shifting.

Impedance matching elements 603, 604, 615, 617, 619 and 621 are designed such that the impedances of the antenna elements 608, 610 and 612 at connection points to the phase shifting elements 614 and 616 match the impedance of the phase shifting elements 614 and 616. The length and width of these impedance matching elements are designed to perform such impedance matching. In the case of the antenna system 600, the impedance of each phase shifting element 614 and 616 is approximately 150 Ohms. The impedance matching elements 603, 604, 615, 617, 619 and 621 are designed, therefore, to match such 50 Ohm impedance at corresponding connection points. The combined impedance at the antenna connector 618 is then the parallel combination of three 150 Ohm loads, which is 50 Ohms. In an exemplary embodiment, 50 Ohms is the impedance seen by connected radio circuitry, such impedance at the desired design input level.

Figure 6B:
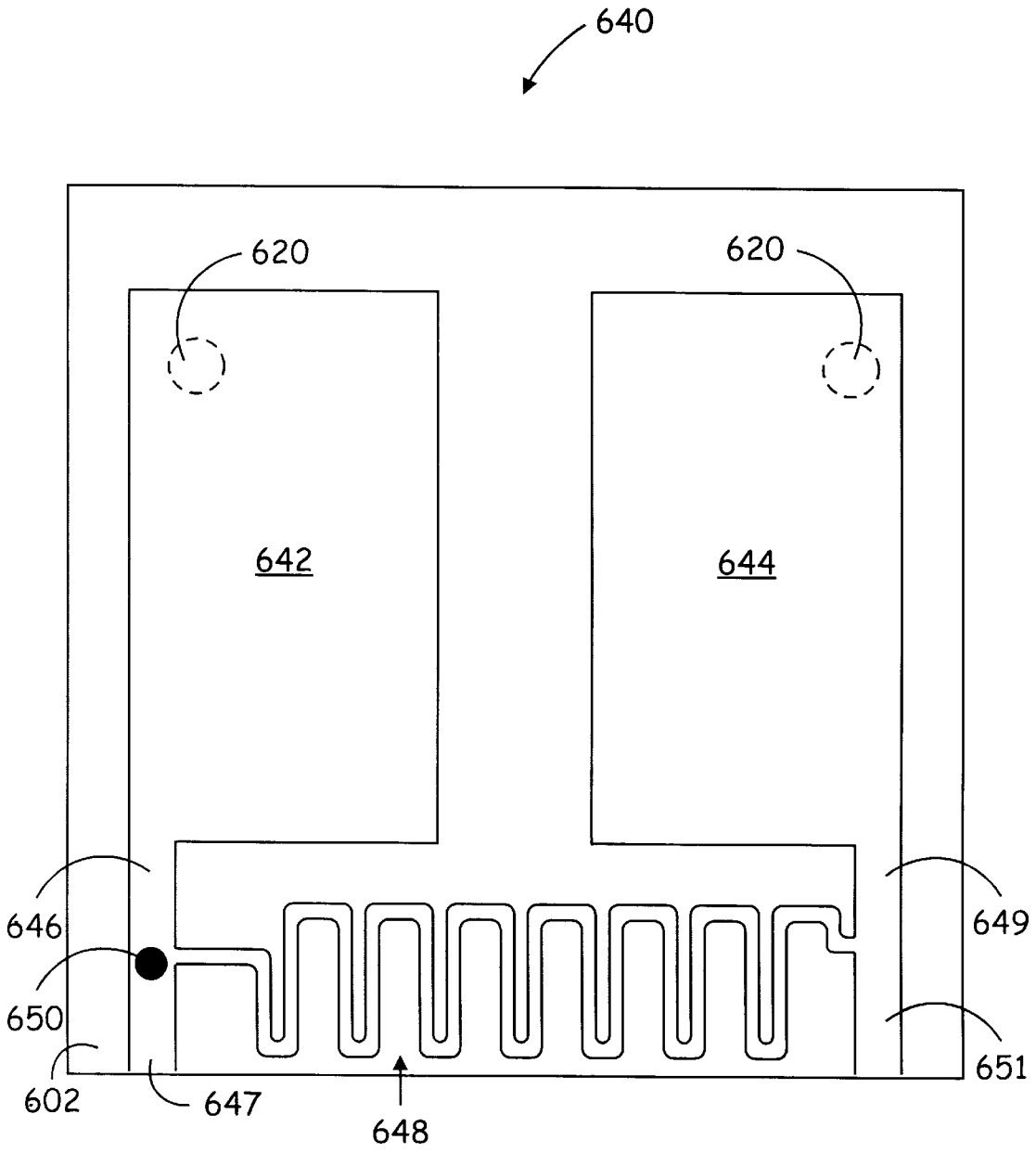
FIG. 6B is a diagrammatic top view of an alternative embodiment of antenna elements of an antenna system according to the present invention.

FIG. 6B is a diagrammatic top view of an alternative embodiment of an antenna system 640 according to the present invention. A first 642 and second 644 antenna elements are disposed upon or substantially adjacent to a dielectric layer 602. Insulative spacers 620 may be employed to physically separate all or a portion of the antenna elements 642 and 644 from the dielectric layer 602 to enhance performance of the antenna system 640.

As shown, a phase shifting element 648 couples the second antenna element 644 to a common antenna connection 650 with a phase shift. The design of such phase shifting element 648, as discussed with reference to FIG. 3, shifts the bandwidth of antenna element 644 so that the bandwidth of the antenna element in combination with the bandwidth of antenna element 642 exceeds the individual bandwidths of the antenna elements 642 and 644. Impedance matching elements 649 and 651 match the impedance of antenna element 644 to phase shifting element 648. Further, impedance matching elements 646 and 647 match the impedance of antenna element 642 to the phase shifting element 648 and such that a design impedance is presented at the common antenna connection 650.

Thus, constructed in combination as it is, the antenna system 640 provides a relatively wider bandwidth from a relatively smaller antenna package. As is evident, the principles discussed with respect to construction of an antenna system according to the present invention may be extended to a greater number of antenna elements using the same or similar principles.

Figure 6C:
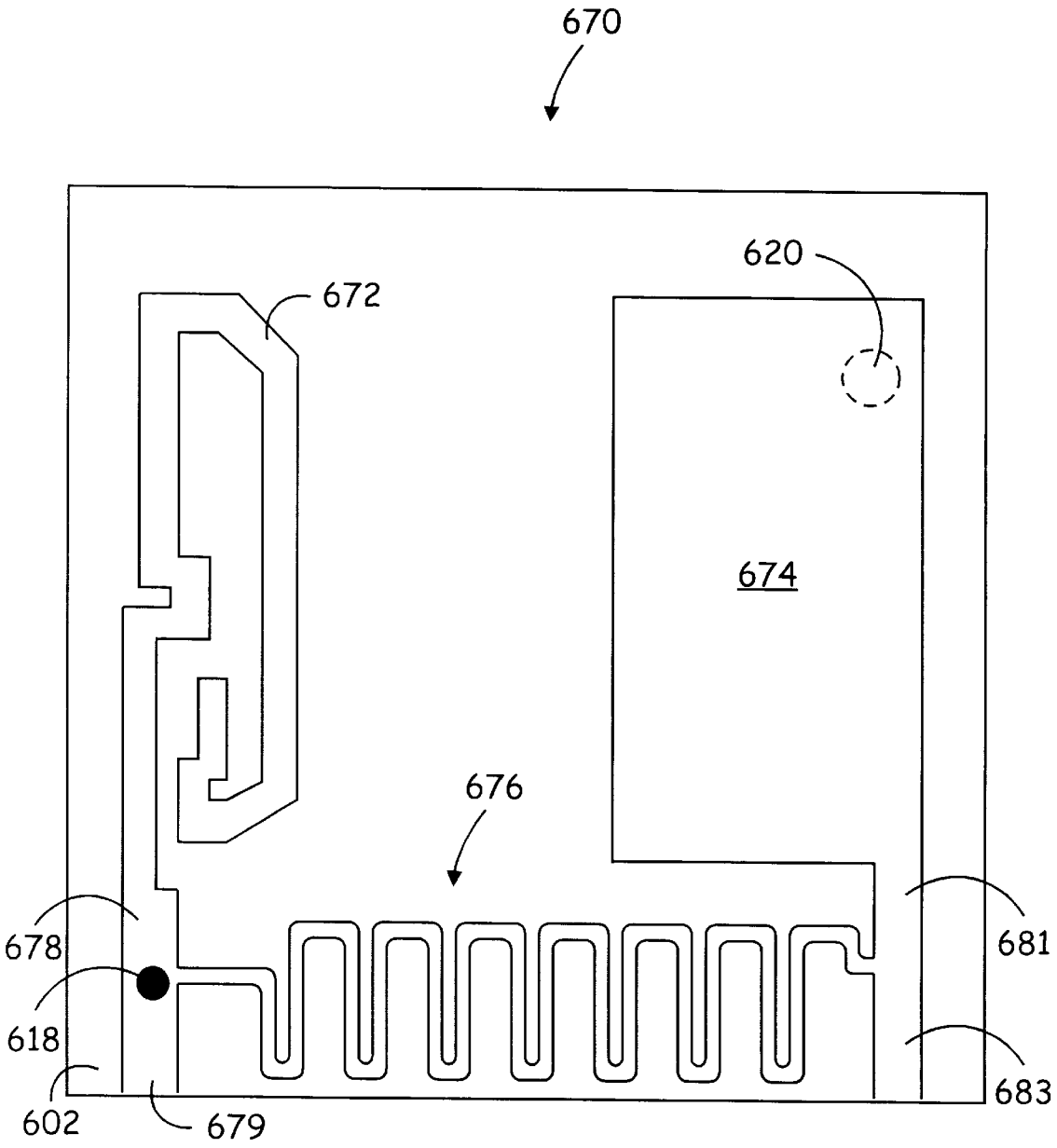
FIG. 6C is a diagrammatic top view of still another embodiment of antenna elements of an antenna system according to the present invention.

FIG. 6C is a diagrammatic top view of still another embodiment of an antenna system 670 according to the present invention. The antenna system 670 includes a first antenna element 672 that conforms to radio circuitry contained within a radio module or to an inner surface of a radio module shell in which it is contained. Thus, the antenna system 670 may be contained in a radio module, such as the one illustrated with respect to FIG. 5C. In another embodiment, the antenna elements may be disposed outside of the radio module shell in a pattern to enhance gain or bandwidth of each antenna element or the antenna system as a whole.

A second antenna element 674 may include a standard shape such as that illustrated, or may include an differing shape designed to conform to other components within the radio module. Phase shifting element 676 couples the antenna element 674 to a common antenna connection 618. Impedance matching elements 681 and 683 match the impedance of the antenna element 674 to the phase shifting element. Further, impedance matching elements 678 and 679 match the impedance of antenna element 672 to the impedance of the phase shifting element 676 and such that a design impedance is presented at the common antenna connection 618. A circuitry connector, such as one previously described, couples the common antenna connection 618 to radio circuitry contained within the radio module.

In view of the above detailed description of the present invention and associated drawings, other modifications and variations will now become apparent to those skilled in the art. It should also be apparent that such other modifications and variations may be effected without departing from the spirit and scope of the present invention as set forth in the claims which follow.

What is claimed is:

1. A broadband antenna system comprising:

a plurality of antenna elements, each antenna element having a respective antenna element operating bandwidth;

a plurality of phase shifting elements, each phase shifting element connecting a respective one of the plurality of antenna elements to a common antenna connection with a respective bandwidth shift, at least two of the phase shifting elements providing transmission paths of different lengths between a respective one of the plurality of antenna elements and the common antenna connection;

a circuitry connector coupled to the common antenna connection; and the plurality of antenna elements, bandwidth shifted by the plurality of phase shifting elements, in cooperation providing an operating bandwidth exceeding the individual element operating bandwidths.

2. The broadband antenna system of claim 1, the circuitry connector transforming frequency design range harmonic impedance at the common antenna connection to a minimum impedance at a second end of the circuitry connector.

3. The broadband antenna system of claim 1, further comprising:

a radio module shell;

radio circuitry contained within the radio module shell coupled to the common antenna connection via the circuitry connector; and the plurality of antenna elements substantially conforming to the radio module shell.

4. The broadband antenna system of claim 3, further comprising:

a dielectric layer disposed upon the radio module shell; and the plurality of antenna elements disposed upon the dielectric layer.

5. The broadband antenna system of claim 3, further comprising:

a dielectric layer disposed upon the radio module shell; and a plurality of insulative spacers connecting the plurality of antenna elements to the dielectric layer such that the antenna elements reside adjacent to, and at least partially away from, the dielectric layer.

6. The broadband antenna system of claim 5, the plurality of insulative spacers positioning the plurality of antenna elements angularly with respect to the radio module shell to enhance performance.

7. The broadband antenna system of claim 1, further comprising:

a radio module shell;

radio circuitry contained within the radio module shell connected to the common antenna connection via the circuitry connector;

a portion of the plurality of antenna elements substantially conforming to the radio module shell; and a portion of the plurality of antenna elements substantially conforming to the radio circuitry.

8. The broadband antenna system of claim 1, further comprising:

a radio module shell;

radio circuitry contained within the radio module shell connected to the common antenna connection via the radio circuitry connector; and at least a portion of the plurality of antenna elements residing within the radio module shell.

9. A broadband radio for operation with a host unit, the broadband radio comprising:

a radio housing;

radio circuitry contained within the radio housing;

a plurality of antenna elements, each antenna element having a respective antenna element operating bandwidth;

a plurality of phase shifting elements disposed adjacent the radio housing, each phase shifting element connecting a respective one of the plurality of antenna elements to a common antenna connection with a respective bandwidth shift, at least two of the phase shifting elements providing transmission paths of different lengths between a respective one of the plurality of antenna elements and the common antenna connection;

a circuitry connector that couples the radio circuitry to the common antenna connection; and the plurality of antenna elements, bandwidth shifted by the plurality of phase shifting elements, in cooperation providing an operating bandwidth exceeding the individual element operating bandwidths.

10. The broadband radio of claim 9, the circuitry connector transforming frequency design range harmonic impedance at the common antenna connection to a minimum impedance at the radio circuitry.

11. The broadband radio of claim 9, the plurality of antenna elements substantially conforming to the radio housing.

12. The broadband radio of claim 9, further comprising:

a dielectric layer disposed upon the radio housing; and the plurality of antenna elements disposed upon the dielectric layer.

13. The broadband radio of claim 9, further comprising:

a dielectric layer disposed upon the radio housing; and a plurality of insulative spacers connecting the plurality of antenna elements to the dielectric layer such that the antenna elements reside adjacent to, and at least partially away from, the dielectric layer.

14. The broadband radio of claim 13, the plurality of insulative spacers positioning the plurality of antenna elements angularly with respect to the radio housing to enhance performance.

15. The broadband radio of claim 9, wherein:

a portion of the plurality of antenna elements substantially conform to the radio housing; and a portion of the plurality of antenna elements substantially conform to the radio circuitry.

16. The broadband radio of claim 9, wherein:

a portion of the plurality of antenna elements resides within the radio housing; and a portion of the plurality of antenna elements reside external to the radio housing.

* * * * *